United States Patent [19]

Yagi et al.

[11] Patent Number: 5,059,501

[45] Date of Patent: Oct. 22, 1991

[54] ELECTROPHOTOGRAPHIC PHOTORECEPTOR WITH OVERLAYER OF AMORPHOUS SI WITH N

[75] Inventors: Shigeru Yagi; Masato Ono; Noriyoshi Takahashi; Masayuki Nishikawa; Yuzuru Fukuda; Kenichi Karakida, all of Kanagawa, Japan

[73] Assignee: Fuji Xerox Co., Ltd., Tokyo, Japan

[21] Appl. No.: 417,969

[22] Filed: Oct. 10, 1989

[30] Foreign Application Priority Data

Oct. 11, 1988 [JP] Japan ..... 63-253857

[51] Int. Cl.[5] ..... G03G 5/14; G03G 5/147

[52] U.S. Cl. ..... 430/65; 430/57; 430/66; 430/67

[58] Field of Search ..... 430/57, 66, 67, 65

[56] References Cited

U.S. PATENT DOCUMENTS 4,394,426 7/1983 Shimiza et al. ..... 430/66 X
4,532,196 7/1985 Yasui et al. ..... 430/57 X
4,666,806 5/1987 Pai et al. ..... 430/66 X
4,760,005 7/1988 Pai ..... 430/67 X
4,889,783 12/1989 Yamazaki ..... 430/66 X
4,923,773 5/1990 Yagi et al. ..... 430/57

FOREIGN PATENT DOCUMENTS 58-145951 8/1983 Japan ..... 430/66

*Primary Examiner*—Roland Martin
*Attorney, Agent, or Firm*—Finnegan, Henderson, Farabow, Garrett and Dunner

[57] ABSTRACT

An electrophotographic photoreceptor having a photosensitive layer essentially made of amorphous silicon formed over a support, and a surface layer made of amorphous silicon formed over the photosensitive layer. The amorphous silicon of the photosensitive layer includes boron of 0.1–5 ppm, and the amorphous silicon of the surface layer includes nitrogen. The layers of material formed over the support include a charge blocking layer.

9 Claims, 1 Drawing Sheet

ELECTROPHOTOGRAPHIC PHOTORECEPTOR WITH OVERLAYER OF AMORPHOUS SI WITH N

BACKGROUND OF THE INVENTION

1. Field of the Invention

The present invention relates to an electrophotographic photoreceptor.

2. Description of the Prior Art

Recently, there have been various proposals for developing an electrophotographic photoreceptor having an amorphous silicon based photosensitive layer formed on a support therein. Electrophotographic photoreceptors having an amorphous silicon based photosensitive layer have a good electrophotographic characteristics in mechanical strength, panchromatic property, and sensitivity for lights having a relatively long wavelength in general.

One of the proposals for further improvement of electrophotographic photreceptors includes an electrophotographic photoreceptor of a function separation type in which the photosensitive layer is functionally divided into a charge generating layer and a charge transporting layer, and other proposals include an electrophotographic photoreceptor in which the photosensitive layer includes boron, and the like (for example, Japanese Patent Unexamined Publication No. 60-112048).

In these more conventional electrophotographic photoreceptors of the type having a surface layer and an amorphous silicon based photosensitive layer, when boron is added into the amorphous silicon based photosensitive layer, the electrophotographic characteristics of the photoreceptor are often not satisfactory, depending in part on the extent of concentration of boron in the photosensitive layer and the material composition of the surface layer provided on the photosensitive layer. More particularly, when the surface layer includes a nitrified amorphous silicon film, image flow or image fading in copied images obtained from the photoreceptors often occurs.

SUMMARY OF THE INVENTION

The present invention overcomes the problems and disadvantages of the prior art.

The object of the present invention is to provide an electrophotographic photoreceptor which has electrophotographic characteristics superior in dark decay, light sensitivity, and image related charge characteristics, and in which image flow or image fading does not occur.

To achieve the object and in accordance with the purpose of the invention, as embodied and broadly described herein, the present invention comprises an electrophotographic photoreceptor having a surface layer which is made of amorphous silicon including nitrogen.

The present invention is broadly based on a finding that, for improved operation, there exists a mutual relation between the extent of concentration of boron, called "the boron content" hereinafter, in the photosensitive layer and the nitrogen content in the surface layer.

The electrophotographic photoreceptor of the present invention includes a charge blocking layer, a photosensitive or photoconductive layer essentially made of amorphous silicon, and a surface layer made of amorphous silicon including nitrogen. Each layer is sequentially formed on a support. The amorphous silicon in the photosensitive layer includes boron of 0.1–5 ppm. The content of nitrogen atoms in a portion of the surface layer which is spaced a given distance from a junction between the photosensitive layer and the surface layer is in the range from 0.1 to 0.7 by atomic ratio relative to silicon atoms.

The accompanying drawing, which is incorporated in and constitutes a part of this specification, illustrates one embodiment of the present invention and together with the description, serves to explain the principles of the invention.

DESCRIPTION OF THE PREFERRED EMBODIMENT

Figure 1:
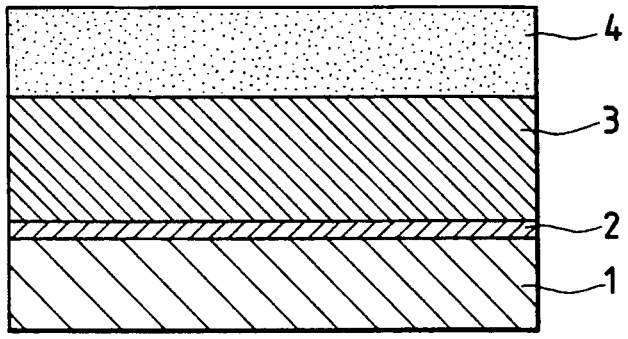
FIG. 1 is a sectional view of an electrophotographic photoreceptor according to an embodiment of the present invention.

Reference will now be made in detail to the present preferred embodiment of the present invention, examples of which are illustrated in the accompanying drawing.

In FIG. 1, a support 1, either an insulating type or an electrically-conductive type, is provided. The insulating type support is treated to make at least the surface thereof adjacent another layer electrically conductive. The base material of the insulating type support may be a film or sheet made out of synthetic resin such as polyester, polyethylene, polycarbonate, polystyrene, polyamide, or the like, or glass, ceramics, paper, or the like. The material of the electrically conductive type support may be a metal such as stainless steel, aluminum, or the like, or an alloy made of such metals, or the like.

A charge blocking layer 2 is formed on support 1. Charge blocking layer 2 is preferably made of amorphous silicon including boron of 50–500 ppm, and has a film thickness of about 2–5 μm.

A photosensitive or photoconductive layer 3 is formed on charge blocking layer 2 and is essentially made of amorphous silicon including boron of 0.1–5 ppm. The boron content less than 0.1 ppm is not sufficient to provide an effect. On the other hand, if the boron content is greater than 5 ppm, dark decay of the electrophotographic photoreceptor will be excessive, sensitivity for red color will decrease and image related charge characteristics will degrade.

The boron content in an amorphous silicon film is determined by measuring the quantities of silicon and boron by a secondary-ion mass spectrometer. Alternatively, it is determined by dissolving the amorphous silicon film into an alkali liquid, thereby performing an IPC light-emission analysis (induction coupled plasma light-emission analysis). The ratio between the content of boron in a vapor phase and the measured boron content in the amorphous silicon film is 2:1, and this ratio does not change significantly when the boron content in the film is within the range from 0.01 to 500 ppm.

Charge blocking layer 2 and photosensitive layer 3 are successively formed on support 1 by glow discharge decomposition. For example, support 1 is placed in a plasma CVD apparatus and a raw material gas is supplied into the apparatus. The raw material gas may be a mixture of a diborane ($B_2H_6$) gas added to silane or a silane derivative. The silane derivative may be $SiH_4$, $Si_2H_6$, $SiCl_4$, $SiHCl_3$, $SiH_2Cl_2$, $Si(CH_3)_4$, $Si_3H_8$, $Si_4H_{10}$, or the like. A hydrogen gas may be supplied into the apparatus simultaneously with a silane gas to make a silane derivative.

If an AC discharge is used, the conditions for forming the films may be suitably set as follows: For example, the frequency is set within the range from 50 Hz to 5 GHz, pressure inside the reactor within the range from $10^{-4}$ to 5 Torr, discharge power within the range from 10 to 2000 W, and temperature of support 1 within the range from 30° to 300° C. The film thickness of the charge generating layer of photosensitive layer 3 is set within the range from 0.1 to 10 μm.

A surface layer 4 is formed on photosensitive layer 3, and is made of amorphous silicon including nitrogen. Surface layer 4 has a single-layer structure in that the concentration of nitrogen or gradient thereof is uniform over the entire area of the film. Alternatively, surface layer 4 constitutes a plurality of nitrified amorphous silicon layers having different levels of nitrogen concentration.

The content of nitrogen atoms in a portion of surface layer 4 which is spaced not more than 100 Å from a junction between surface layer 4 and photosensitive layer 3 is in the range from 0.1 to 0.7 by atomic ratio relative to silicon atoms. When the content of nitrogen atoms in such portion of surface layer 4 is greater than 0.7, image flow or image fading occurs. On the other hand, when the content of nitrogen atoms is smaller than 0.1, sensitivity for light waves having a relatively short wavelength will decrease.

A raw material gas is supplied into the plasma CVD apparatus to perform glow discharge decomposition for forming surface layer 4, similarly to the forming of photosensitive layer 3 described above. In the forming of surface layer 4, a mixture of silane and ammonia gasses as the raw material gas is supplied, and the ratio of flow between the ammonia and silane gasses is controlled such that the atomic ratio between nitrogen and silicon atoms in surface layer 4 is not greater than 0.7.

If an AC discharge is used, other process parameters may be suitably set as follows: for example, the frequency is set within the range from 50 GHz, pressure inside the reactor within the range from $10^{-4}$ to 5 Torr, and discharge power within the range from 10 to 2000 W. The film thickness of surface layer 4 is set within the range from 0.1 to 10 μm.

EXAMPLE 1

A mixture of silane ($SiH_4$) and diborane ($B_2H_6$) gasses was decomposed by glow discharge by a capacitance-coupled plasma CVD apparatus, which is capable of forming an amorphous silicon film onto a cylindrical support, to form a charge blocking layer having a film thickness of about 4 μm on a cylindrical aluminum support. The conditions for forming the film were set as follows:

Flow of 100% silane gas: 150 $cm^3$/min
Flow of 200 ppm hydrogen diluted diborane gas: 150 $cm^3$/min
Reactor inside pressure: 0.5 Torr
Discharge power: 200 W
Discharge time: 1 hr
Discharge frequency: 13.56 MHz
Temperature of support: 250° C.

After forming the charge blocking layer, a mixture of silane and diborane gasses was supplied into the reactor and decomposed through glow discharge to form a photosensitive layer having a film thickness of about 20 μm on the charge blocking layer. The conditions for forming the film were set as follows:

Flow of 100% silane gas: 200 $cm^3$/min
Flow of 100 ppm hydrogen diluted diborane gas: 6 $cm^3$/min
Reactor inside pressure: 0.8 Torr
Discharge power: 200 W
Discharge time: 4 hr
Discharge frequency: 13.56 MHz
Temperature of support: 250° C.

The boron content in the photosensitive layer was measured to be 3 ppm.

After formation of the photosensitive layer, the reactor was sufficiently purged, and a mixture of silane, hydrogen, and ammonia gases was supplied into the reactor and decomposed through glow discharge to form a surface layer having a film thickness of about 0.3 μm on the photosensitive layer. The conditions for forming the film were set as follows:

Flow of 100% silane gas: 30 $cm^3$/min
Flow of 100% hydrogen gas: 100 $cm^3$/min
Flow of 100% ammonia gas: 30 $cm^3$/min
Reactor inside pressure: 0.5 Torr
Discharge power: 50 W
Discharge time: 1 hr.
Discharge frequency: 13.56 MHz
Temperature of support: 250° C.

The atomic-number ratio between nitrogen and silicon atoms in the surface layer was measured to be 0.6.

When all the layers for an electrophotographic photoreceptor were formed, the photoreceptor was electrically charged to provide a surface potential of +500 V under the temperature of 20° C. and relative humidity of 15%, and then exposed to image-carrying light. The half-decay exposure E50 was measured to be 3 erg/$cm^2$ at the wave length of 600 nm, and the residual potential was +10 V. Further, the copied image obtained from the photoreceptor had a good resolution (7 lp/mm).

EXAMPLES 2 and 3

An electrophotographic photoreceptor was formed similarly as described in Example 1. However, in Examples 2 and 3, the quantity of the diborane gas supplied into the CVD apparatus for forming the photosensitive layer was changed respectively as shown in Table 1, and similarly, the quantities of the ammonia and silane gases supplied for forming the surface layer were changed respectively as shown in Table 1. The copied images were obtained similarly as in Example 1 by the electrophotographic photoreceptor thus formed and the qualities of the copied images in Examples 2 and 3 are shown respectively in Table 1.

TABLE 1

| | Photosensitive layer | | Surface layer | | |
|---|---|---|---|---|---|
| | diborane (cm3/min) | boron content (ppm) | ammonia/silane (cm3/min) | N/Si ratio | Quality of copied images |
| Example 2 | 6 | 3 | 20/40 | 0.4 | good (7 lp/mm) |
| Example 3 | 2 | 1 | 20/40 | 0.4 | good (7 lp/mm) |
| Comparative Example 1 | 2 | 1 | 45/15 | 0.85 | extreme image fading |
| Comparative Example 1 | 6 | 3 | 45/15 | 0.85 | extreme image fading |

In the electrophotographic photoreceptor of the present invention, the photosensitive layer essentially made of amorphous silicon contains boron of 0.1–5 ppm, and the content ratio of nitrogen atoms relative to silicon atoms in the surface layer made of amorphous silicon including nitrogen in a portion in the surface layer spaced within at least 100 Å from the junction between the surface and photosensitive layers is set to be within the range from 0.1 to 0.7 by atomic rate. The electrophotographic photoreceptor of the present invention provides a superior electrophotographic characteristics with respect to dark decay, sensitivity, and image related charge characteristics, to the conventional photoreceptors, and image flow or image fading does not occur in copied images obtained therefrom.

Other embodiments of the invention will be apparent to those skilled in the art from consideration of the specification and practice of the invention disclosed herein. It is intended that the specification and examples by considered as exemplary only, with a true scope and spirit of the invention being indicated by the following claims.

What is claimed is:

1. An electrophotographic photoreceptor comprising:

a support;

a charge blocking layer overlying the support, comprising hydrogenated amorphous silicon including boron of 50–5,000 ppm;

a photosensitive layer overlying the charge blocking layer, essentially made of amorphous silicon including boron of 0.1–5 ppm; and a surface layer overlying the photosensitive layer, made of amorphous silicon including nitrogen having an atomic ratio greater than or equal to about 0.1 and less than about 0.5 with respect to silicon.

2. The photoreceptor of claim 1, wherein said nitrogen of said armorphous silicon of the surface layer having said atomic ratio is spaced a predetermined distance not greater than 100 Å from a junction between the surface and photosensitive layers.

3. An electrophotographic photoreceptor comprising:

a support;

a charge blocking layer overlying the support, comprising hydrogenated amorphous silicon including boron of 50–5000 ppm;

a photosensitive layer overlying the charge blocking layer, essentially made of amorphous silicon including boron of 0.1–1 ppm; and a surface layer overlying the photosensitive layer, made of amorphous silicon including nitrogen having an atomic ratio greater than or equal to about 0.1 and less than about 0.5 with respect to silicon.

4. An electrophotographic photoreceptor comprising:

a support;

at least one layer overlying the support comprising a photosensitive layer essentially made of amorphous silicon, said amorphous silicon including boron of 0.1–5 ppm, said at least one layer including a charge blocking layer having boron of greater than or equal to 50 ppm and less than 100 ppm; and a surface layer made of amorphous silicon including nitrogen overlying the photosensitive layer, said nitrogen in a portion of the surface layer that is spaced a predetermined distance not greater than 100 Å from a junction between the surface and photosensitive layers having an atomic ratio greater than or equal to about 0.1 and less than about 0.5 with respect to silicon.

5. An electrophotographic photoreceptor comprising:

a support;

at least one layer overlying the support comprising a photosensitive layer essentially made of amorphous silicon, said amorphous silicon including boron of 0.1–5 ppm; and a surface layer made of amorphous silicon overlying the photosensitive layer, said surface layer including a plurality of nitrified amorphous silicon layers each having a different level of nitrogen concentration, said nitrogen in a portion of the surface layer that is spaced a predetermined distance not greater than 100 Å from a junction between the surface and photosensitive layers having an atomic ratio greater than or equal to about 0.1 and less than about 0.5 with respect to silicon.

6. The photoreceptor of claim 4, wherein said charge block layer is disposed between the support and the photosensitive layer.

7. The photoreceptor of claim 4, wherein the concentration of nitrogen atoms in a portion of the surface layer that is spaced a predetermined distance not greater than 100 Å from a junction between the surface and photosensitive layers is within the range from 0.1 to 0.7 by atomic ratio relative to the concentration of silicon atoms in said portion.

8. The photoreceptor of claim 5, wherein said at least one layer comprises a charge blocking layer.

9. The photoreceptor of claim 8 wherein said charge blocking layer is disposed between the support and the photosensitive layer.

* * * * *